US005634443A

United States Patent [19]

Mathews

[11] Patent Number: 5,634,443

[45] Date of Patent: Jun. 3, 1997

[54] METHOD AND SYSTEM FOR CONTROLLING ONE OF A GLOW PLUG HEATER SYSTEM AND A GRID HEATER SYSTEM IN AN AUTOMOTIVE VEHICLE

[75] Inventor: Jacob Mathews, Dearborn, Mich.

[73] Assignee: Ford Motor Company, Dearborn, Mich.

[21] Appl. No.: 560,569

[22] Filed: Nov. 20, 1995

[51] Int. Cl.[6] ..... F02N 17/02

[52] U.S. Cl. ..... 123/179.21; 123/142.5 E

[58] Field of Search ..... 123/142.5 E, 179.21

[56] References Cited

U.S. PATENT DOCUMENTS

| | | | |
|---|---|---|---|
| 4,103,661 | 8/1978 | Holt | 123/179.6 |
| 4,658,772 | 4/1987 | Auth et al. | 123/145 A |
| 4,667,645 | 5/1987 | Gluckman | 123/179.8 |
| 4,862,370 | 8/1989 | Arnold et al. | 364/431.1 |
| 4,884,033 | 11/1989 | McConchie, Sr. | 324/503 |
| 4,944,260 | 7/1990 | Shea et al. | 123/179 H |
| 5,063,513 | 11/1991 | Shank et al. | 123/142.5 E |
| 5,094,198 | 3/1992 | Trotta et al. | 123/179.21 |
| 5,347,966 | 9/1994 | Mahon et al. | 123/179.21 |
| 5,365,438 | 11/1994 | Mitchell et al. | 364/424.03 |
| 5,367,996 | 11/1994 | Homik et al. | 123/179.21 |
| 5,385,126 | 1/1995 | Matthews | 123/179.21 |
| 5,482,013 | 1/1996 | Andrews et al. | 123/179.21 |

*Primary Examiner*—Erick R. Solis

*Attorney, Agent, or Firm*—Donald A. Wilkinson; Roger L. May

[57] ABSTRACT

A method and system for controlling one of a glow plug heater system and a grid heater system in an automotive vehicle. A common controller is provided programmed with a first control algorithm for controlling a glow plug heater system and a second control algorithm for controlling a grid heater system. A control signal is obtained upon detecting whether the heater system is a glow plug heater system or a grid heater system. Based on the control signal, the common controller then controls the glow plug heater system according to the first control algorithm and controls the grid heater system according to the second control algorithm. The common controller further includes a diagnostic algorithm for performing a self-diagnostic test on the heater system upon receiving a diagnostic signal generated either manually or automatically.

14 Claims, 11 Drawing Sheets

A
B
C
D
E
NO
ARE RELAY CONT. CLOSED ?
72
YES
NO
DELAY 100MS
73
IS ENGINE CRANKED ?
74
YES
NO
DELAY 2 SEC. TURN OFF WTS LAMP
62
FLASH ERROR FOR 10 SEC.
64
IS TEMP > 45 F ?
75
NO
YES
GLOW PLUG MODE SELECTED ?
78
NO (A,B) = (0,1)
YES (A,B) = (1,0)
TO GRID HEATER ROUTINE
82
TO GLOW PLUG ROUTINE
80
DELAY 2 SEC. TURN OFF WTS LAMP
76
END CYCLE ALL OUTPUTS OFF
65

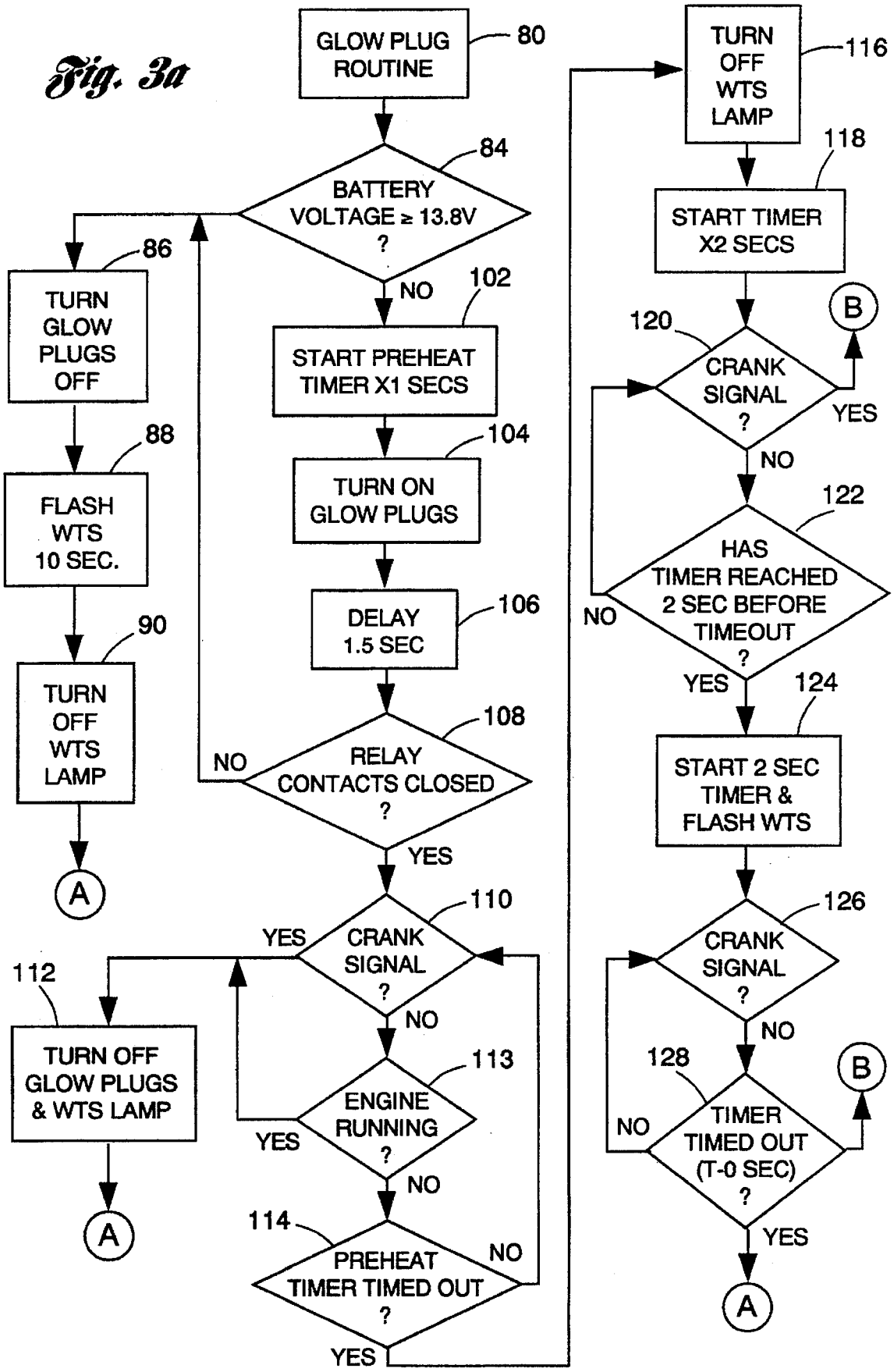
Fig. 3a
GLOW PLUG ROUTINE
80
BATTERY VOLTAGE ≥ 13.8V ?
84
NO
TURN GLOW PLUGS OFF
86
FLASH WTS 10 SEC.
88
TURN OFF WTS LAMP
90
A
START PREHEAT TIMER X1 SECS
102
TURN ON GLOW PLUGS
104
DELAY 1.5 SEC
106
RELAY CONTACTS CLOSED ?
108
NO
YES
CRANK SIGNAL ?
110
YES
NO
TURN OFF GLOW PLUGS & WTS LAMP
112
A
ENGINE RUNNING ?
113
YES
NO
PREHEAT TIMER TIMED OUT ?
114
NO
YES
TURN OFF WTS LAMP
116
START TIMER X2 SECS
118
CRANK SIGNAL ?
120
YES
B
NO
HAS TIMER REACHED 2 SEC BEFORE TIMEOUT ?
122
NO
YES
START 2 SEC TIMER & FLASH WTS
124
CRANK SIGNAL ?
126
NO
TIMER TIMED OUT (T-0 SEC) ?
128
NO
B
YES
A B
TURN ON FUEL SOL.
130
TURN OFF TIMER WTS LAMP ON
132
133
ENGINE CRANKED ?
YES
NO
DELAY 1 SEC
134
135
ENGINE RUNNING ?
NO
YES
136
ENGINE CRANKED ?
YES
NO
137
WTS LAMP OFF DELAY 2 SEC
138
ENGINE RUNNING ?
NO
YES
WTS LAMP OFF
156
START POST HEAT TIMER X3 SECS
140
142
ENGINE RUNNING ?
NO
YES
C
D
E

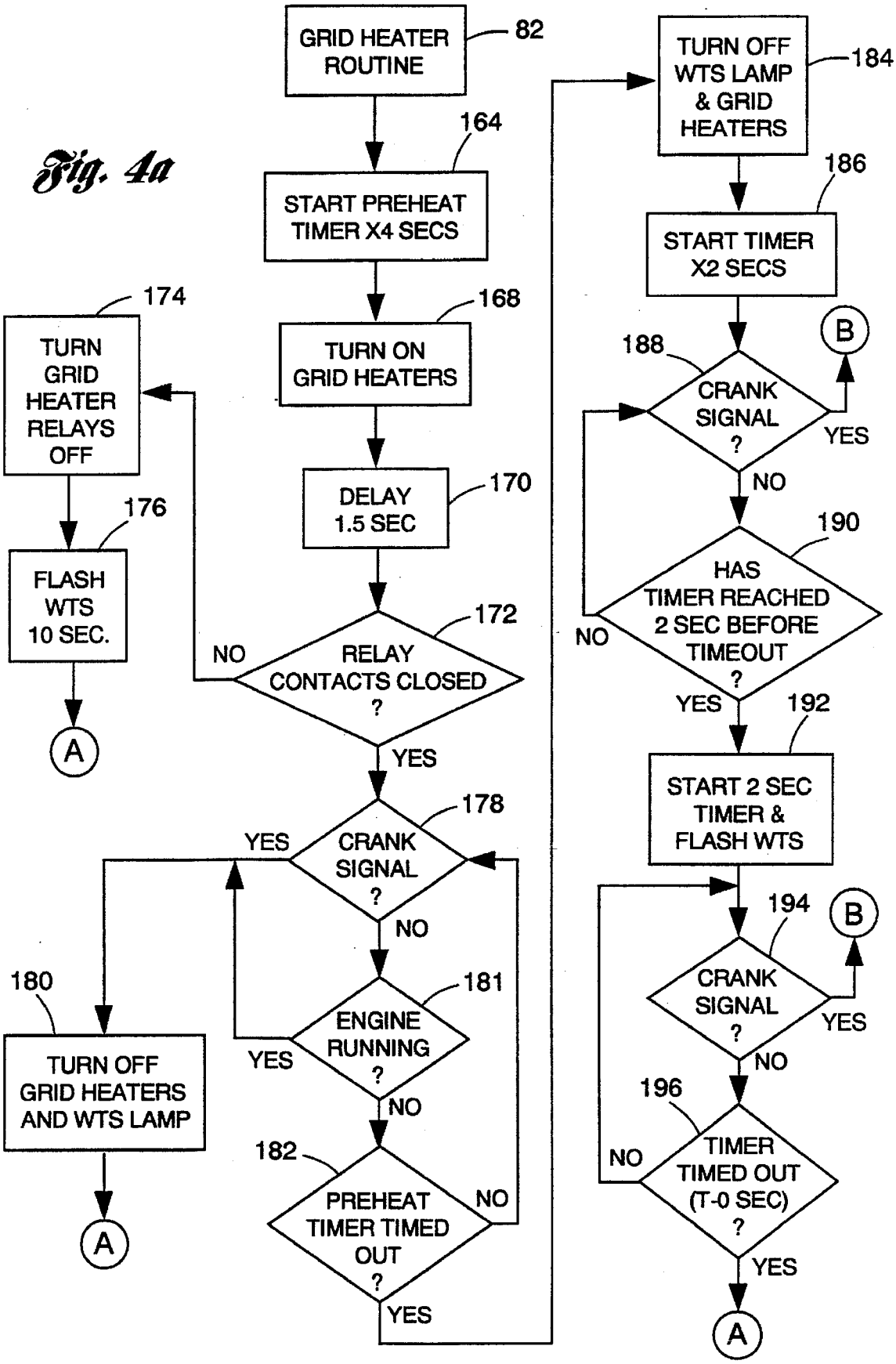
Fig. 4a
GRID HEATER ROUTINE
82
START PREHEAT TIMER X4 SECS
164
TURN ON GRID HEATERS
168
DELAY 1.5 SEC
170
RELAY CONTACTS CLOSED ?
172
NO
YES
CRANK SIGNAL ?
178
YES
NO
ENGINE RUNNING ?
181
YES
NO
PREHEAT TIMER TIMED OUT ?
182
NO
YES
TURN GRID HEATER RELAYS OFF
174
FLASH WTS 10 SEC.
176
A
TURN OFF GRID HEATERS AND WTS LAMP
180
A
TURN OFF WTS LAMP & GRID HEATERS
184
START TIMER X2 SECS
186
CRANK SIGNAL ?
188
YES
B
NO
HAS TIMER REACHED 2 SEC BEFORE TIMEOUT ?
190
NO
YES
START 2 SEC TIMER & FLASH WTS
192
CRANK SIGNAL ?
194
YES
B
NO
TIMER TIMED OUT (T-0 SEC) ?
196
NO
YES
A B
TURN OFF TIMER
WTS LAMP ON
200
201
ENGINE
CRANKED
?
YES
NO
202
DELAY
1 SEC
203
ENGINE
RUNNING
?
NO
YES
204
ENGINE
CRANKED
?
YES
NO
205
WTS LAMP OFF
DELAY 2 SEC
206
ENGINE
RUNNING
?
NO
YES
WTS
LAMP
OFF
220
START POST HEAT
TIMER X5 SECS
& TURN ON
GRID HEATER
208
210
ENGINE
RUNNING
?
NO
YES
C
D
E A
322
ERROR CODE #1 PRESENT ?
YES
END
NO
324
RELAY #1 OPEN OR SHORT CONTACTS ?
YES
326
INDICATE ERROR CODE #5
NO
328
ERROR CODE #2 PRESENT ?
YES
NO
330
GRID HEATER MODE DETECTED ?
NO
YES
332
RELAY #2 OPEN OR SHORT CONTACTS ?
YES
334
INDICATE ERROR CODE #6
NO
336
CRANK SIGNAL ?
NO
338
INDICATE ERROR CODE #7
YES

METHOD AND SYSTEM FOR CONTROLLING ONE OF A GLOW PLUG HEATER SYSTEM AND A GRID HEATER SYSTEM IN AN AUTOMOTIVE VEHICLE

TECHNICAL FIELD

This invention relates to air intake heater systems and, more particularly, to a dual mode controller for controlling both a glow plug heater system and a grid heater system.

BACKGROUND ART

Cold diesel engines are difficult to start. Leakage and heat losses due to the air being compressed reduce the final compression pressure and temperature to such a degree that the engine can no longer be started without the use of an auxiliary starting device. The lowest temperature threshold is a function of the engine design.

Various prior art devices have been employed to effect heat transfer to intake air of a diesel engine. One device employed to improve cold starting characteristics of diesel engines is a glow plug device. The glow plug is located within each combustion chamber of the diesel engine. Each of the glow plugs are connected in parallel to the vehicle battery. Power is applied to the glow plugs prior to engine cranking in order to raise the temperature of the plugs high enough to initiate fuel combustion.

A second known device employed to improve cold starting characteristics of diesel engines is a grid heater system. Heater grids are mounted in front of the air intake manifold of the engine to increase the inlet manifold air temperature. The grid heater system has the effect of heating the combustion air in the engine and improving starting performance when temperatures drop below the ambient temperature required for a diesel engine to ignite fuel.

Each of these heater systems are controlled differently. Automotive manufacturers, therefore, may be required to stock controllers for each of these heater systems when each of these heater systems are used for different vehicles. Thus, complexity is increased.

DISCLOSURE OF THE INVENTION

It is thus a general object of the present invention to provide a method and system for controlling one of a glow plug heater system and a grid heater system while minimizing complexity.

In carrying out the above objects and other objects, features and advantages, of the present invention, a method is provided for controlling one of a glow plug heater system and a grid heater system. The method includes the step of providing a common controller programmed with a first control algorithm for controlling a glow plug heater system and a second control algorithm for controlling a grid heater system. The method also includes the step of detecting whether the heater system is a glow plug heater system or a grid heater system to obtain a control signal. Finally, in response to the control signal, the controller controls the glow plug heater system according to the first control algorithm and controls the grid heater system according to the second control algorithm.

In further carrying out the above objects and other objects, features and advantages, of the present invention, a system is also provided for carrying out the steps of the above-described method. The system includes a common controller programmed with a first controller algorithm for controlling a glow plug heater system and a second control algorithm for controlling a grid heater system. The system further includes means for detecting whether the heating system is a glow plug heater system or a grid heater system to obtain a control signal. The common controller then controls the glow plug heater system according to the first control algorithm and the grid heater system according to the second control algorithm based on the control signal.

The above objects and other objects, features and advantages of the present invention are readily apparent from the detailed description of the best mode for carrying out the invention when taken in connection with the accompanying drawings.

BRIEF DESCRIPTION OF THE DRAWINGS

FIGS. 3*a*–3*c* is a flow chart illustrating the glow plug routine of the method of the present invention;

FIGS. 4*a*–4*c* is a flow chart illustrating the grid heater routine of the method of the present invention.

BEST MODES FOR CARRYING OUT THE INVENTION

Figure 1:
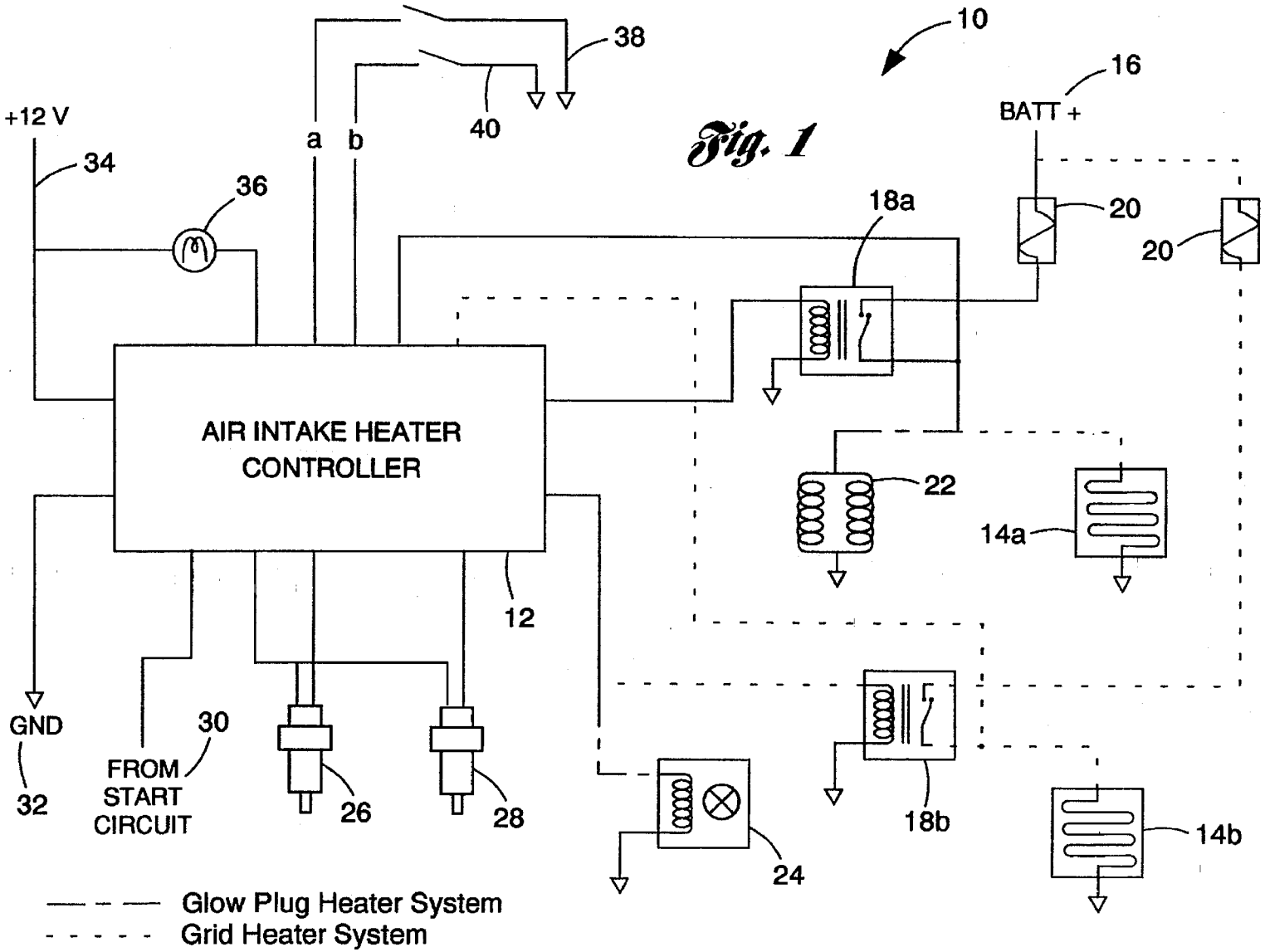
FIG. 1 is a schematic diagram of the system of the present invention.

Turning now to FIG. 1, the system of the present invention is shown, denoted generally by reference numeral 10. The system 10 includes a common controller 12 for controlling both a glow plug heater system and a grid heater system, as will be described in more detail below. The connections to the common controller 12 for a glow plug heater system is shown by the dashed line, while the connections required for the grid heater system is shown by the dotted lines.

The system 10 includes two individually operable heater grids 14*a*, 14*b*. The heater grids 14*a*, 14*b* are typically mounted in front of an air intake manifold (not shown) of an engine (not shown). One end of the heater grids 14*a*, 14*b* are connected to ground, while the other end of the heater grids 14*a*, 14*b* are connected to battery 16 via relays 18*a*, 18*b*. The relays 18*a*, 18*b* receive power signals from the common controller 12 and switch power to the heater grids 14*a*, 14*b* accordingly. Also, a fuse 20 is preferably provided between the relays 18*a*, 18*b* and the battery 16.

In a glow plug heater system, the heater grid 14*a* is replaced with glow plugs 22, as shown by the dashed line in FIG. 1. Furthermore, the relay 18*b* and the grid heater 14*b* are eliminated and a fuel solenoid 24 is utilized. The intake air is heated by the combustion of fuel in the glow plugs 22. Fuel is supplied to the glow plugs 22 via the fuel solenoid 24.

Inputs to the common controller 12 include an engine temperature input via an engine temperature sensor 26, an oil pressure switch input via an oil pressure switch 28 and an engine crank input via an engine crank sense 30. The common controller 12 includes a power ground 32 to provide a vehicle ground and a power feed 34 to provide power of approximately 12.0 VDC. The system 10 further includes an indicator lamp 36 connected to the common controller 12 for providing a low side output driver signal thereto. The indicator lamp 36, typically a #196 bulb, is a dash mounted lamp. The common controller 12 thus provides connection to power distribution, sensor/switch, relay control and instrument panel vehicle wire harnesses.

Finally, the common controller 12 is provided with a System Configuration Pin A 38 and a System Configuration Pin B 40 which are used to select the operating mode of the common controller 12. Selection of Pin A 38 or Pin B 40 is done by providing ground to the pin. For example, the following table illustrates the various operating modes of the common controller 12 based on the configuration of Pin A 38 and Pin B 40:

| Pin A | Pin B | Operating Mode |
|---|---|---|
| Open | Open | Error State |
| Open | Grounded | Glow Plug Heater System |
| Grounded | Open | Grid Heater System |
| Grounded | Grounded | System Diagnostics |

Thus, upon detecting System Configuration Pin A 38 being open and System Configuration Pin B 40 being grounded, the common controller 12 controls the air intake heater system according to the requirements of a glow plug heater system. Similarly, the common controller 12 controls the air intake heater system according to the requirements of a grid heater system if Pin A 38 is grounded and Pin B 40 is open.

If Pin A 38 and Pin B 40 are both open, the common controller 12 detects an error in the system 10. If Pin A 38 and Pin B 40 are both grounded, the common controller 12 performs a system diagnostic check, as will be described in more detail below. The diagnostic mode may be selected manually using a switch. Alternatively, the diagnostic mode of operation may be selected automatically by the common controller 12.

Figure 2A:
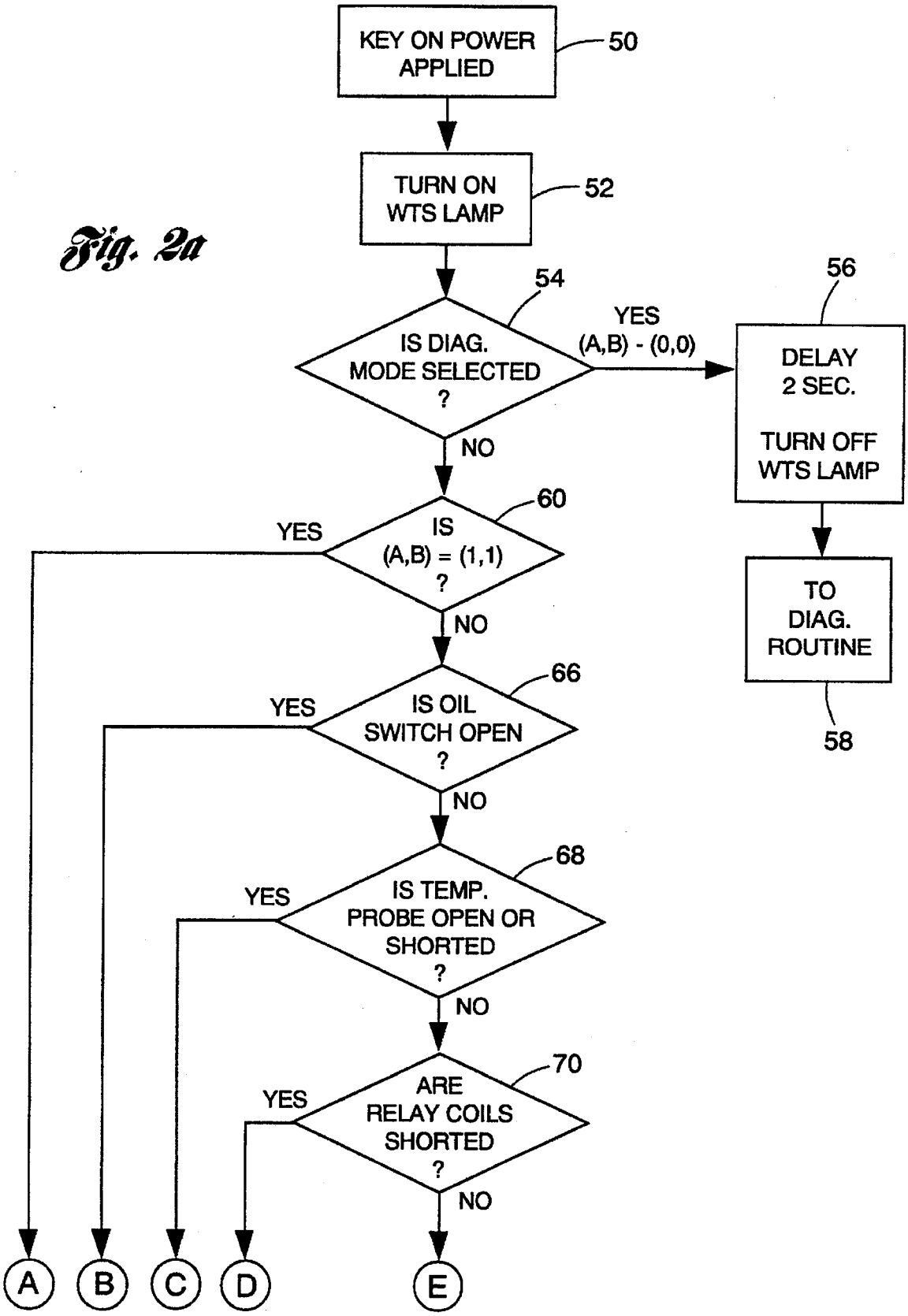
FIG. 2*a*–2*b* is a flow chart illustrating both the operation of the system shown in FIG. 1 and the method of the invention.
Figure 2B:
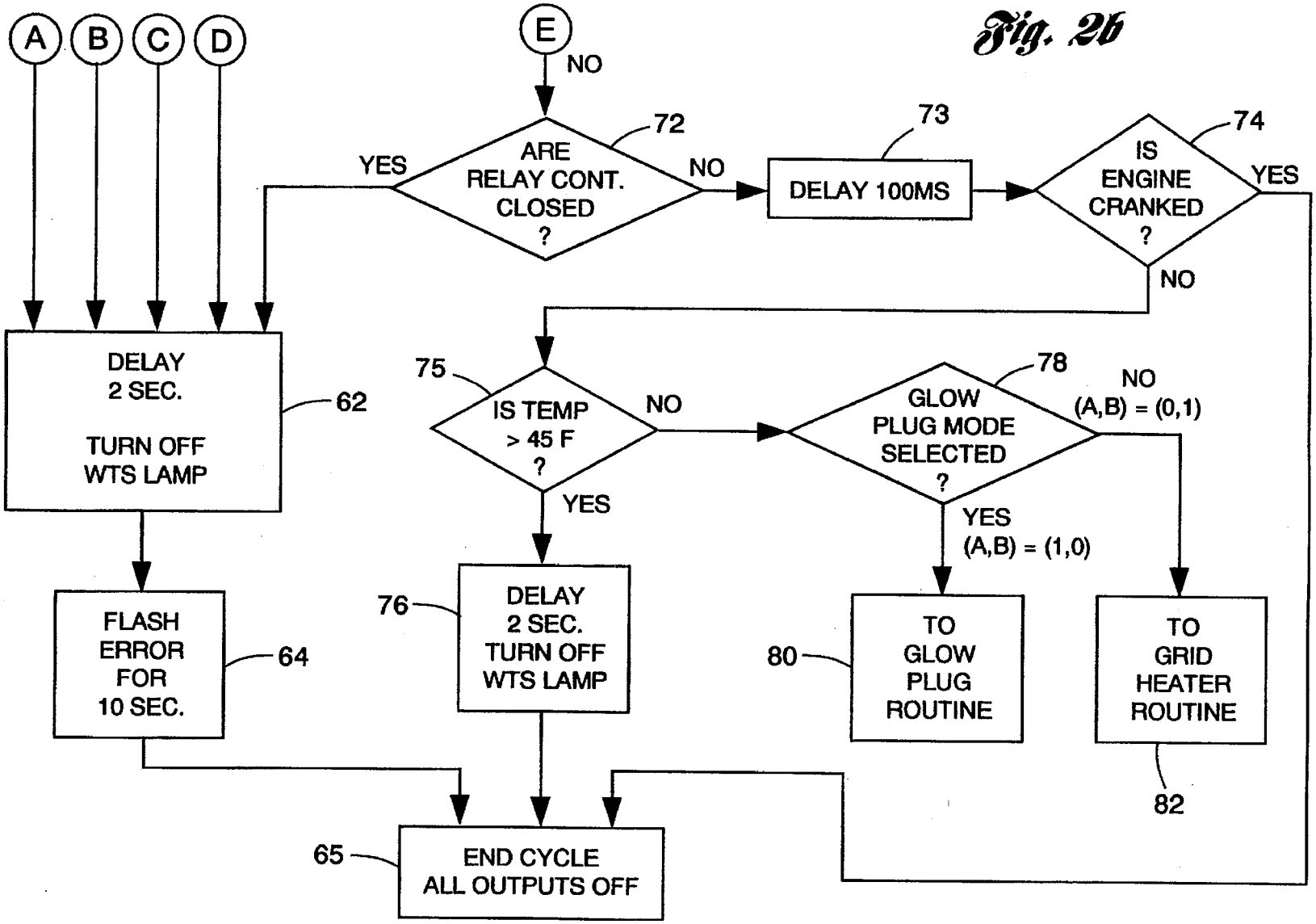

Turning now to FIGS. 2*a*–2*b*, the operation of the system 10 will be described in more detail. First, power is applied and the indicator lamp 36, generally referred to as a Wait to Service (WTS) lamp, is turned on, as shown by blocks 50 and 52, respectively. Next, a check is made to determine whether the diagnostic mode of operation is selected, as shown at conditional block 54. If the diagnostic mode of operation is selected, there is a delay of approximately two seconds and the WTS lamp 36 is turned off, as shown at block 56. The diagnostic routine is then entered, as shown at block 58, which will be described in greater detail below.

If the diagnostic mode of operation is not selected, a check is made as to whether there is an error, as shown at conditional block 60. If there is an error, the WTS lamp 36 is turned off after a delay of approximately two seconds and an error code is flashed for approximately ten seconds as shown at blocks 62 and 64, respectively. All outputs are turned off and the cycle is ended, as shown at block 65. The method continues to determine if other errors are present such as an open oil switch, an open or shorted temperature probe, shorted relay coils, or closed relay contacts, as shown at conditional blocks 66, 68, 70 and 72, respectively.

If there are no errors, after a delay of approximately 100 msec, a check is made as to whether or not the engine is cranked, as shown at block 73 and conditional block 74, respectively. If the engine is cranked, all outputs are turned off, as shown at block 65. If the engine is not cranked, the method proceeds to determine whether the engine temperature is greater than a predetermined temperature threshold, preferably 45° F., as shown at conditional block 75.

If the engine temperature exceeds the predetermined temperature threshold, the method proceeds to turn off the indicator lamp 36 after a delay of approximately two seconds, as shown at block 76, and all outputs are turned off. If the engine temperature does not exceed the predetermined temperature threshold, the method proceeds to determine whether a glow plug mode of operation is selected, as shown at conditional block 78. If the glow plug mode of operation is selected, the method proceeds to the glow plug routine, as shown at block 80. If not, the method proceeds to the grid heater routine, as shown at block 82.

Figure 3B:
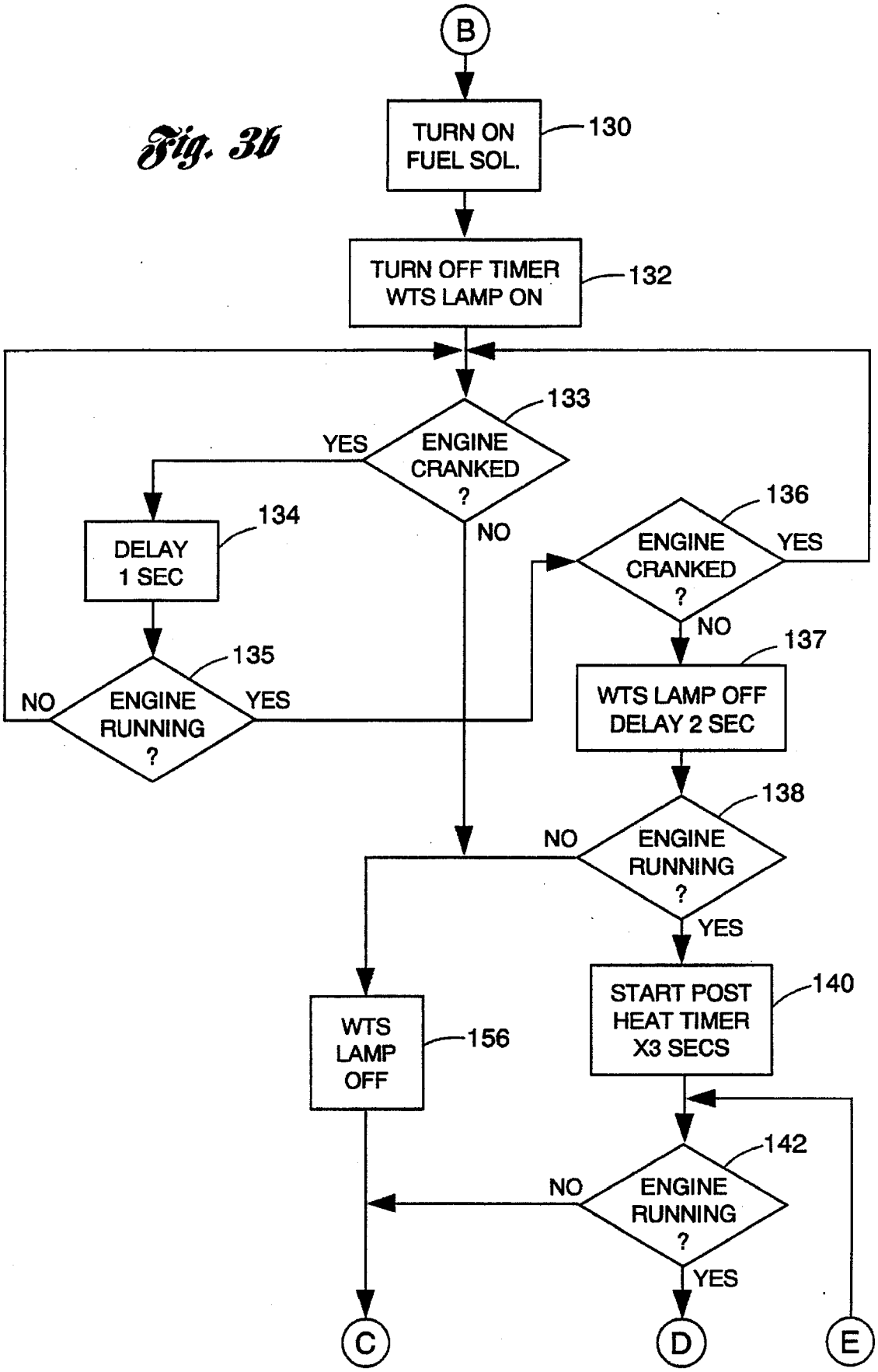
Figure 3C:
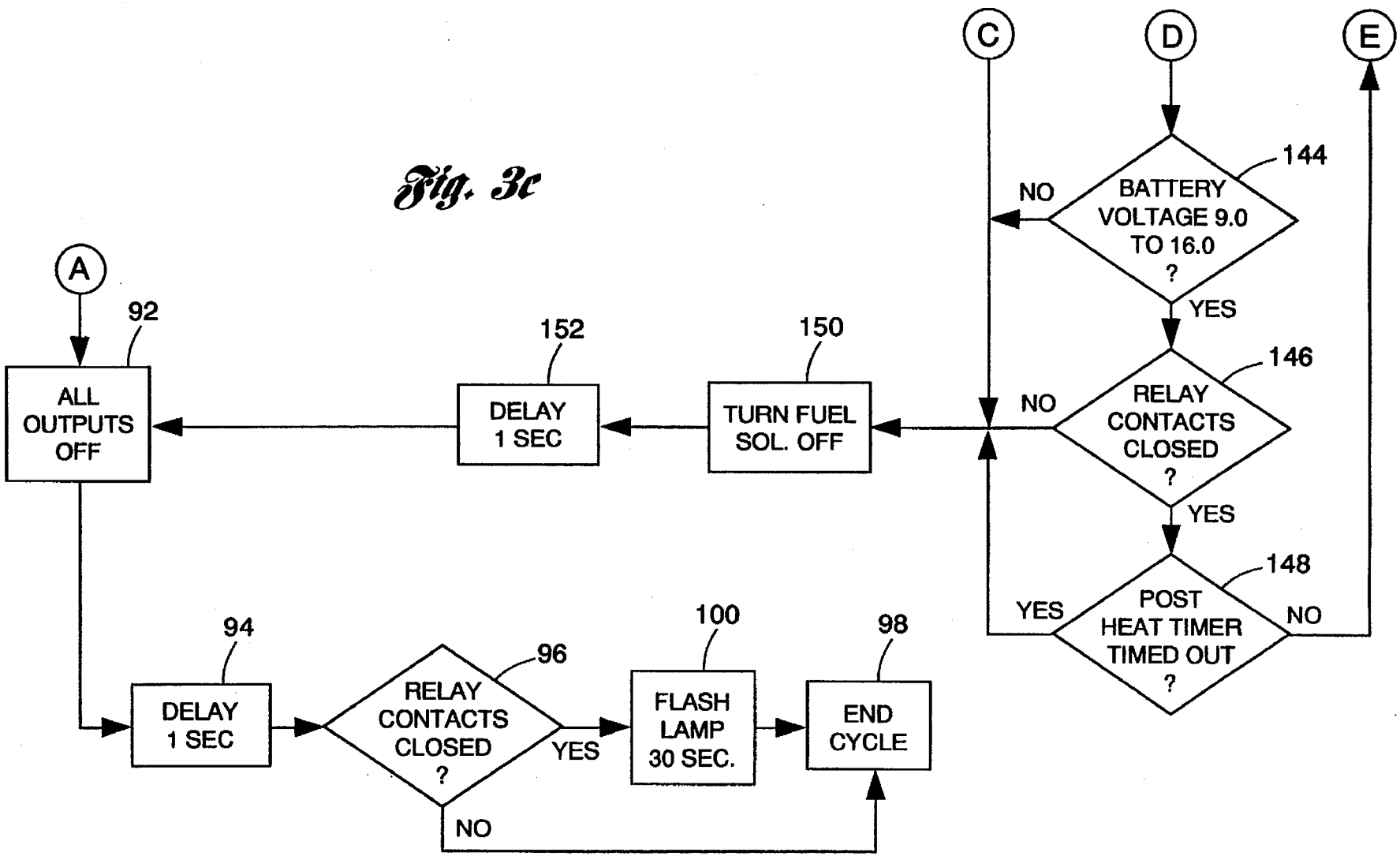

The common controller 12 operates a glow plug heater system according to the glow plug routine, as indicated at block 80, which will now be described. Referring now to FIGS. 3*a*–3*c*, first the battery voltage is compared to a predetermined voltage level, as shown at conditional block 84. If the battery voltage exceeds the predetermined voltage threshold, the glow plugs 22 are turned off, as shown at block 86, and the WTS lamp 36 is flashed for a time period of approximately ten seconds, as shown at block 88. The WTS lamp 36 is then turned off as shown at block 90. All outputs are then turned off, as shown at block 92. After a delay of approximately one second, as shown by block 94, the relay contacts are checked to see if they are open or closed, as shown by conditional block 96. If the relay contacts are open, the cycle is ended, as shown at block 98. If the relay contacts are closed, the WTS lamp 36 is flashed for approximately thirty seconds, as shown at block 100, and the cycle is ended, as shown at block 98.

If the battery voltage is less than the voltage threshold, a preheat timer is started, as shown at block 102. The glow plugs 22 are then turned on, as shown at block 104. The method waits a predetermined amount of time, e.g., approximately 1.5 seconds, and checks to see if the relay contacts are open or closed, as shown by block 106 and conditional block 108, respectively. If the relay contacts are open, the glow plugs 22 are turned off, as shown by block 86 and the routine continues as described above.

If the relay contacts are closed, the method proceeds to determine whether there is a crank signal, as shown at conditional block 110. If the crank signal is present, the glow plugs 22 and the WTS lamp 36 are turned off, as shown at block 112. All outputs are turned off, as shown by block 92, and the method proceeds to end the cycle as described above.

If the crank signal is not present, the method proceeds to determine if the engine is running as shown at conditional block 113. If the engine is running, the glow plugs 22 and the WTS lamp 36 are turned off as described above. If the engine is not running, the method proceeds to determined if the preheat timer has timed out, as shown at conditional block 114. If not, the method continues to look for the crank signal until the preheat timer times out.

If the preheat timer has timed out, the method continues to turn off the WTS lamp 36, as shown at block 116. A second timer is set as shown by block 118. The method then checks to see if a crank signal is present, as shown at conditional block 120. If the crank signal is not present, the method continues to determine if the timer has reached two seconds before its time out, as shown at conditional block 122. If not, the method continues to look for the crank signal. If the timer has reached the two seconds before the time out, a two second timer is started and the WTS lamp 36 is flashed, as shown at block 124.

Again, the method continues to determine whether a crank signal is present, as shown at conditional block 126. If not, a check is made as to whether or not the timer has timed out, as shown at conditional block 128. If the timer is not timed out, the method continues to determine whether a crank signal is present until the timer times out. If the timer has timed out, the method continues to turn all outputs off, as shown at block 92, and the method proceeds to end the cycle as described above.

If the crank signal is detected either at block 120 or block 126, the method continues to turn on the fuel solenoid 24, as shown at block 130. The timer and the WTS lamp 36 are then turned off, as shown at block 132. The method continues to determine whether the engine is cranked, as shown at conditional block 133. If so, the method waits a predetermined amount of time, e.g., 1 sec, and then determines if the engine is running, as shown at block 134 and conditional block 135, respectively. If the engine is not running, the method returns to block 133.

If the engine is running, a check is made again to determine if the engine is cranked, as shown at conditional block 136. If the engine is cranked, the method returns to block 133. Upon determining the engine is not cranked, the WTS lamp 36 is turned off and there is a delay of approximately 2 sec., as shown at block 137. Next, the method proceeds to check if the engine is running, as shown at conditional block 138. If the engine is running, a post heat timer is started, as shown at block 140.

Following the start of the post-heat timer, the method checks to determine if the engine is running, the battery voltage is within a predetermined voltage threshold, the relay contacts are closed, and the post-heat timer is timed out, as shown at conditional blocks 142, 144, 146 and 148, respectively. If the engine is not running, the battery voltage is not within the predetermined voltage threshold, the relay contacts are open, and the post-heat timer has timed out, the method proceeds to turn the fuel solenoid 24 off, as shown at block 150. There is a delay of approximately 1 second, as shown at block 152, all the outputs are turned off, as shown at block 92, and the method proceeds to end the cycle as described above.

Returning to block 133, if the engine is not cranked, the method continues to turn off the WTS lamp 36, as shown at block 156. The fuel solenoid is turned off after a delay and all outputs are turned off, as described above.

Figure 4B:
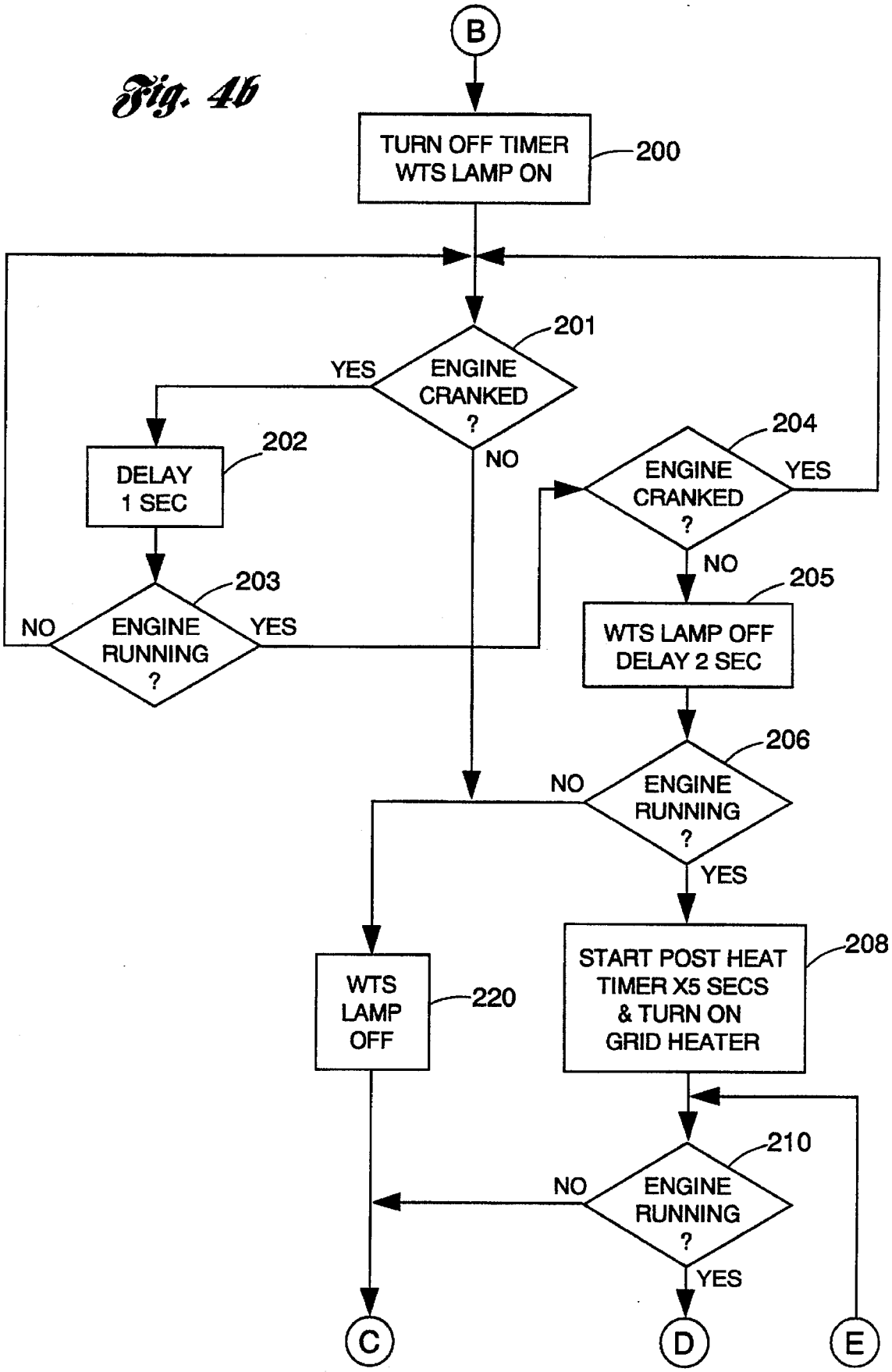
Figure 4C:
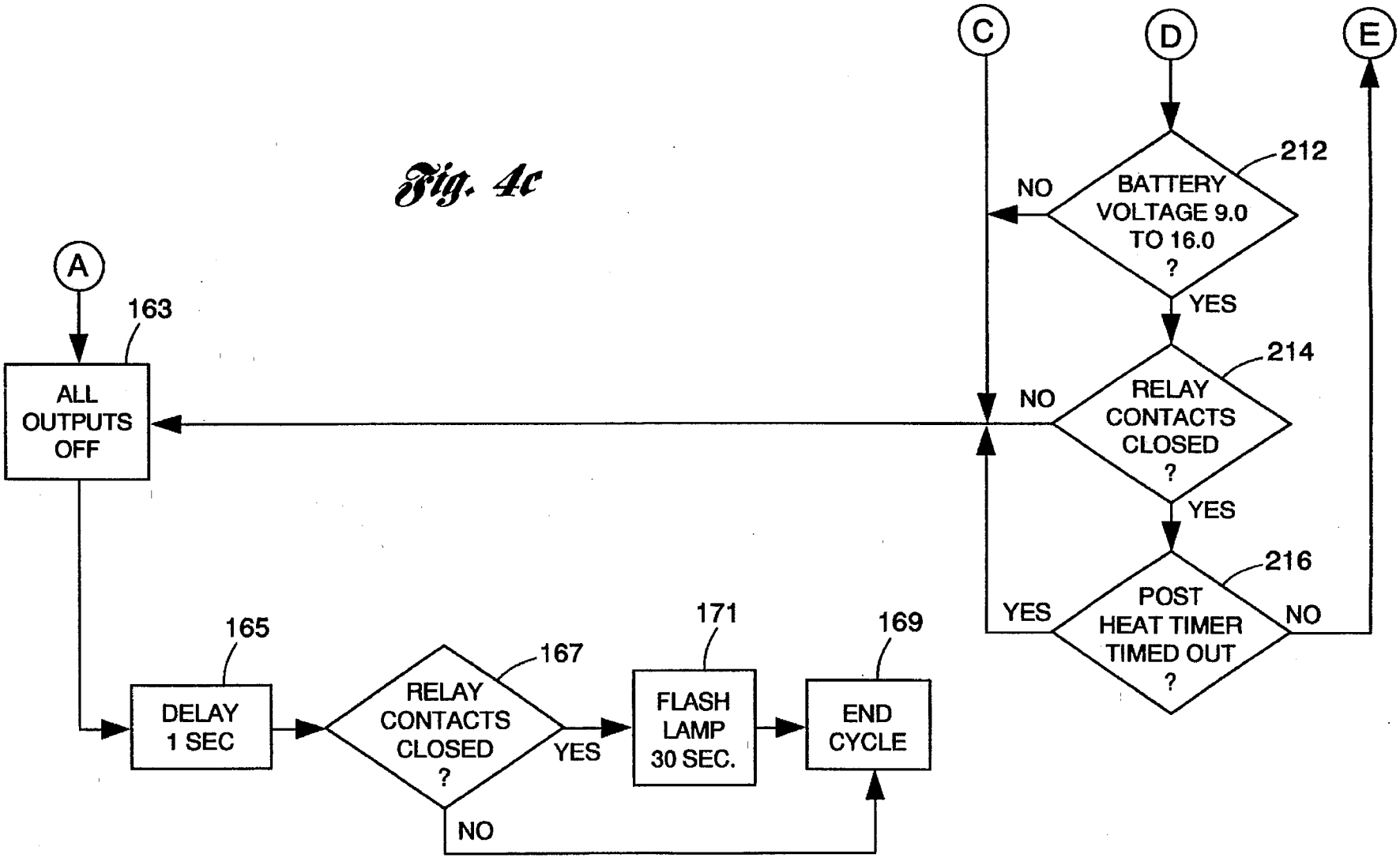

Referring now to FIGS. 4*a*–4*c*, the grid heater routine 82 will now be described. The pre-heat timer is started, as shown at block 164, and the heater grids 14*a*, 14*b* are turned on, as shown at block 168. After a delay of approximately 1.5 seconds, a check is made as to whether the relay contacts are closed, as shown at block 170 and conditional block 172, respectively. If the relay contacts are not closed, the heater grids 14*a*, 14*b* are turned off, as shown at block 174. The WTS lamp 36 is then flashed for approximately 10 seconds, as shown at block 176.

Next, all the outputs are turned off, as shown at block 163. After a delay of approximately one second, as shown by block 165, the relay contacts are checked to see if they are open or closed, as shown by conditional block 167. If the relay contacts are open, the cycle is ended, as shown at block 169. If the relay contacts are closed, the WTS lamp 36 is flashed for approximately thirty seconds, as shown at block 171, and the cycle is ended, as shown at block 169.

Returning to block 172, if the relay contacts are closed, the method proceeds to determine if a crank signal is present as shown at conditional block 178. If the crank signal is present, the heater grids 14*a*, 14*b* as well as the WTS lamp 36 are turned off, as shown at block 180. All the outputs are then turned off, as shown by block 163, and the method proceeds to end the cycle as described above.

If the crank signal is not present, a check is made as to whether or not the engine is running, as shown at conditional block 181. If the engine is running, the glow plugs 22 and the WTS lamp 36 are turned off as described above. If the engine is not running, the method proceeds to determine if a pre-heat timer has timed out, as shown at conditional block 182. If not, the method continues to check for the crank signal until the timer has timed out. Once the pre-heat timer has timed out, the method proceeds to turn the WTS lamp 36 off as well as the heater grids 14*a*, 14*b*, as shown at block 184.

Next, the method proceeds to set a timer, as shown by block 186. The method then checks to see if a crank signal is present, as shown at conditional block 188. If the crank signal is not present, the method continues to determine if the timer has reached two seconds before its time out, as shown at conditional block 190. If not, the method continues to look for the crank signal. If the timer has reached the two seconds before the time out, a two second timer is started and the WTS lamp 36 is flashed, as shown at block 192.

Again, the method continues to determine whether a crank signal is present, as shown at conditional block 194. If not, a check is made as to whether or not the timer has timed out, as shown at conditional block 196. If the timer is not timed out, the method continues to determine whether a crank signal is present until the timer times out. If the timer has timed out, the method continues to turn all outputs off, as shown at block 163, and the method proceeds to end the cycle as described above.

Upon sensing the crank signal at either block 188 or 194, the method directly proceeds to turn off the timer and turn on the WTS lamp 36, as shown at block 200. A check is then made as to whether the engine is cranked, as shown at conditional block 201. If so, the method waits a predetermined amount of time, e.g., 1 sec., and then determines if the engine is running, as shown at block 202 and conditional block 203, respectively. If the engine is not running, the method returns to block 201.

If the engine is running, a check is made again to determine if the engine is cranked, as shown at conditional block 204. If the engine is cranked, the method returns to block 201. If the engine is not cranked, the WTS lamp 36 is turned off and there is a delay of approximately 2 sec., as shown at block 205. Next, the method proceeds to check if the engine is running, as shown at conditional block 206. If the engine is running, a post heat timer is started and the heater grids 14*a* and 14*b* are turned on, as shown at block 208.

After the post-heater timer is started and the heater grids 14*a*, 14*b* are turned on, the method proceeds again to determine if the engine is running, the battery voltage is within a predetermined voltage threshold, the relay contacts closed, and the post-heat timer is timed out, as shown at blocks 210, 212, 214 and 216, respectively. If the engine is not running, the battery voltage is not within the predetermined voltage threshold, the relay contacts are open, and the post-heat timer has timed out, all outputs are turned off, as shown at block 163, and the method proceeds to end the cycle as described above.

Returning to block 201, if the engine is not cranked, the method continues to turn off the WTS lamp 36, as shown at block 220. All outputs are turned off as described above.

Figure 5A:
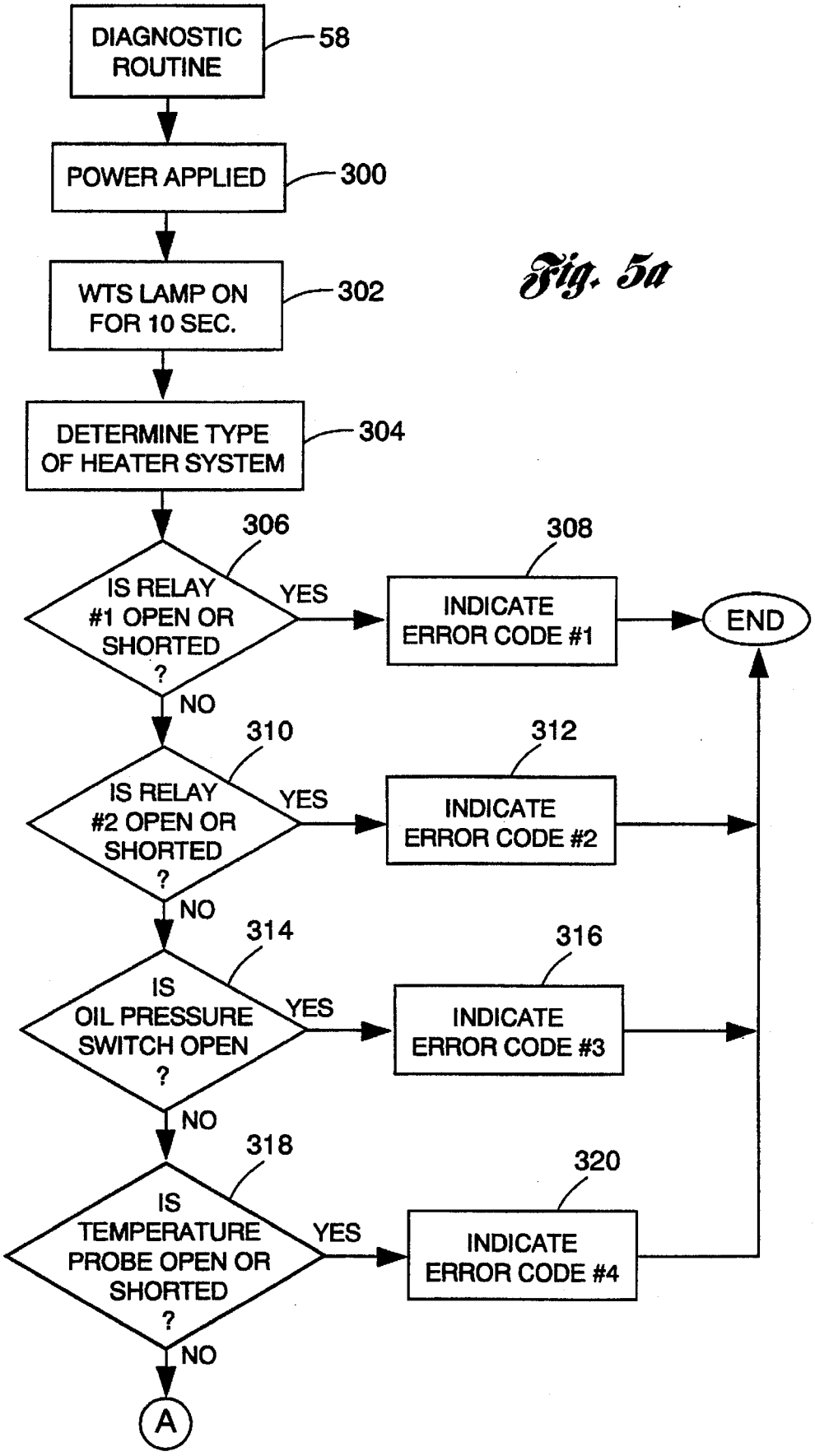
FIGS. 5*a*–5*b* is a flow chart illustrating the diagnostic routine of the method of the present invention.
Figure 5B:
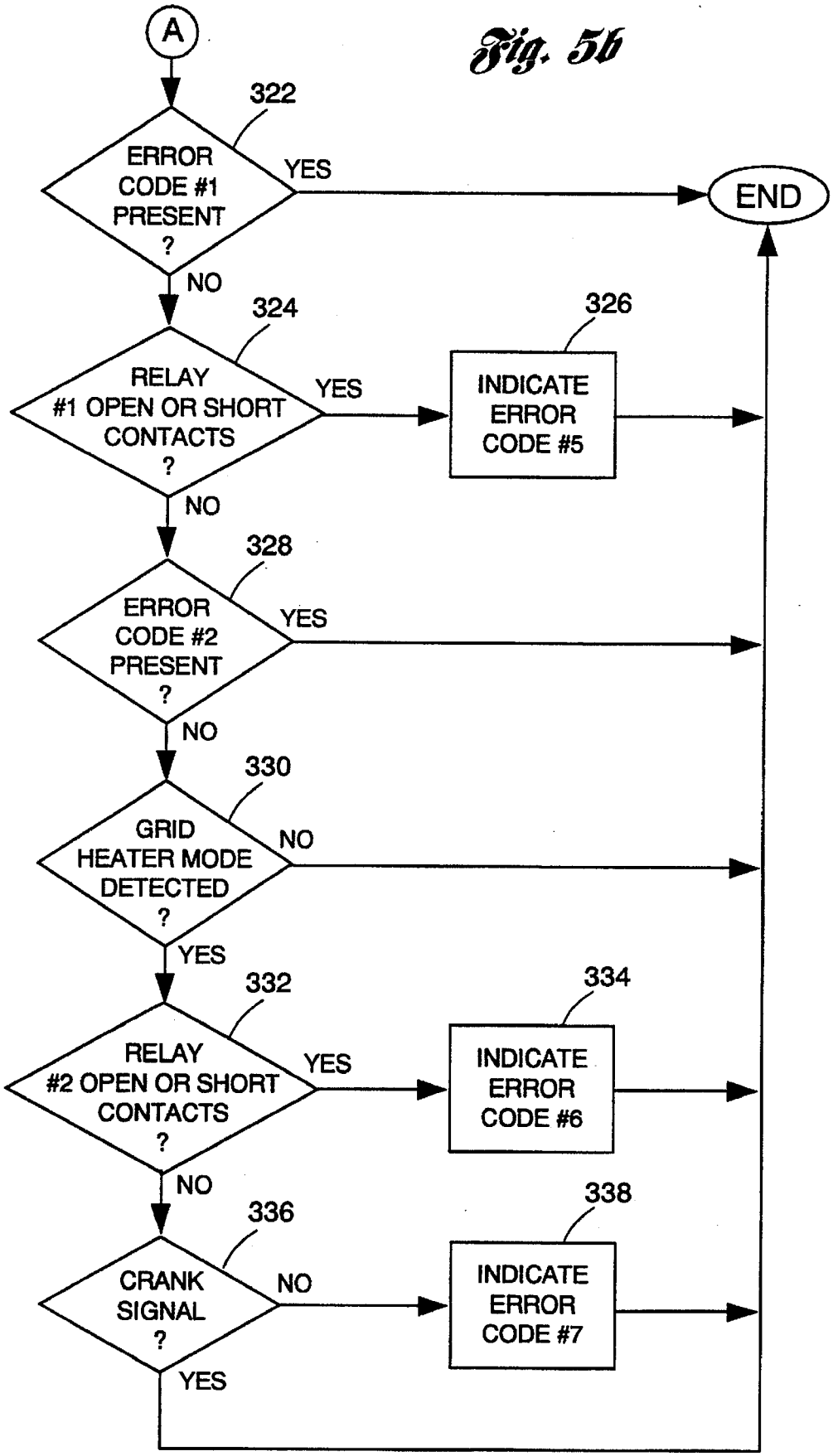

Turning now to FIGS. 5*a* and 5*b*, the diagnostic routine, as shown at block 58, will now be described in detail. When the diagnostic mode of operation is selected, power is supplied and the WTS lamp 36 is turned on for a predetermined amount of time, e.g., 10 seconds, as shown at blocks 300 and 302, respectively. Next, the method proceeds to determine the type of heater system the common controller 12 is operating, as shown at block 304. The relay 18*a* is checked in the energized condition to confirm that the load is not an open or short-circuit, as shown at conditional block 306. If relay 18*a* is open or shorted, the WTS lamp 36 will provide a first error code according to a first predetermined waveform, as shown at block 308. For example, the WTS lamp 36 may repeatedly flash on for a half-second and off for two seconds.

Next, relay 18*b* is checked in the energized condition to confirm that the load is not an open or short-circuit, as shown at conditional block 310. If relay 18*b* is open or shorted, the WTS lamp 36 provides a second error code according to a second predetermined waveform, as shown at block 312. The oil pressure switch input is then checked for a high voltage level indicating a fault, as shown at conditional block 314. A failure will cause the WTS lamp 36 to flash according to a third predetermined waveform to generate a third error code, as shown at block 316.

The temperature probe input from the engine temperature sensor 26 is checked for an open or shorted condition indicating a fault, as shown at conditional block 318. A failure will cause the WTS lamp 36 to flash according to a fourth predetermined waveform to indicate a fourth error code, as shown at block 320.

If the first error code is not present, the relay 18*b* is reactivated and the output is checked for short or open contacts, as shown at conditional blocks 322 and 324, respectively. If this error condition is present, the WTS lamp 36 will flash according to a fifth predetermined waveform, as shown at block 326. If the second error code is not present, and the grid heater mode was detected, relay 18*b* is reactivated and the output is checked for short or open contacts, as shown at conditional blocks 328, 330 and 332, respectively. If relay 18*b* has open or short contacts, the WTS lamp 36 will flash according to a sixth predetermined waveform, as shown at block 334.

Next, the method proceeds to determine if a crank signal is present, as shown at conditional block 336. If the common controller 12 is functioning properly, the WTS lamp 36 will stop flashing indicating that a correct input was received, and the test is ended. If the common controller 12 is not functioning properly, the WTS lamp 36 will continue to flash according to a seventh predetermined waveform to indicate that it has not sensed a crank signal, as shown at block 338. At the conclusion of the test, the outputs and the WTS lamp 36 are turned off.

While the best modes for carrying out the invention have been described in detail, those familiar with the art to which this invention relates will recognize various alternative designs and embodiments for practicing the invention as defined by the following claims.

What is claimed is:

1. A system for controlling one of a glow plug heater system and a grid heater system in an automotive vehicle comprising:

a common controller programmed with a first control algorithm for controlling a glow plug heater system and a second control algorithm for controlling a grid heater system;

at least one configurable pin for selecting one of the glow plug heater system and the grid heater system and generating a corresponding control signal; and the common controller controlling the glow plug heater system according to the first control algorithm and controlling the grid heater system according to the second control algorithm based on the control signal.

2. The system as recited in claim 1 wherein the common controller is further programmed with a diagnostic algorithm for performing a self-diagnostic test on the system and the system further comprises the at least one configurable pin for generating a diagnostic signal and in response to the diagnostic signal, the common controller performing the self-diagnostic test according to the diagnostic algorithm.

3. The system as recited in claim 2 wherein the at least one configurable pin for generating the diagnostic signal includes a switch for manually generating the diagnostic signal.

4. The system as recited in claim 2 wherein the diagnostic signal is generated automatically.

5. The system as recited in claim 2 further comprising a display for displaying the outcome of the self-diagnostic test.

6. The system as recited in claim 5 wherein the display is a lamp.

7. A method for controlling one of a glow plug heater system and a grid heater system in an automotive vehicle comprising:

providing a common controller programmed with a first control algorithm for controlling a glow plug heater system and a second control algorithm for controlling a grid heater system and having at least one configurable pin;

detecting whether the heater system is a glow plug heater system or a grid heater system based on a configuration of the at least one configurable pin and generating a corresponding control signal; and the controller controlling the glow plug heater system according to the first control algorithm and controlling the grid heater system according to the second control algorithm based on the control signal.

8. The method as recited in claim 7 wherein the common controller is further programmed with a diagnostic algorithm for performing a self-diagnostic test on the system and the method further comprises the step of generating a diagnostic signal and in response to the diagnostic signal, the common controller performing the self-diagnostic test according to the diagnostic algorithm.

9. The method as recited in claim 8 wherein the step of generating the diagnostic signal includes the step of manually generating the diagnostic signal.

10. The method as recited in claim 9 wherein the step of manually generating the diagnostic signal is performed utilizing a switch.

11. The method as recited in claim 8 wherein the step of generating the diagnostic signal includes the step of automatically generating the diagnostic signal.

12. The method as recited in claim 8 further comprising the step of displaying the outcome of the self-diagnostic test.

13. The method as recited in claim 12 wherein the step of displaying is performed utilizing a lamp.

14. A system for controlling one of a glow plug heater system and a grid heater system in an automotive vehicle and for performing a diagnostic test, the system comprising:

a common controller programmed with a first control algorithm for controlling a glow plug heater system, a second control algorithm for controlling a grid heater system, and a diagnostic algorithm for performing a self-diagnostic test on the system;

at least one configurable pin for selecting one of the glow plug heater system, the grid heater system or the diagnostic test and generating a corresponding control signal; and the common controller controlling the glow plug heater system according to the first control algorithm, controlling the grid heater system according to the second control algorithm, or performing the self-diagnostic test according to the diagnostic algorithm based on the control signal.

* * * * *